United States Patent [19]

Fischer et al.

[11] Patent Number: 4,494,741

[45] Date of Patent: Jan. 22, 1985

[54] TISSUE CUTTING AND INTERFOLDING APPARATUS FOR Z WEBS

[75] Inventors: David L. Fischer; William E. Waterstreet, both of Green Bay, Wis.

[73] Assignee: John M. Rudolf, Green Bay, Wis.

[21] Appl. No.: 481,118

[22] Filed: Apr. 1, 1983

Related U.S. Application Data

[63] Continuation-in-part of Ser. No. 246,053, Mar. 20, 1981, abandoned.

[51] Int. Cl.[3] ..... B41L 1/32

[52] U.S. Cl. ..... 270/39; 493/433; 83/100

[58] Field of Search ..... 270/39, 40; 493/353, 493/356, 357, 359, 360, 433, 430, 425, 410, 418; 83/100

[56] References Cited

U.S. PATENT DOCUMENTS

| | | | |
|---|---|---|---|
| 1,186,018 | 6/1916 | Meisel | 493/430 X |
| 1,756,392 | 4/1930 | Smith | 270/39 |
| 1,823,475 | 9/1931 | Scudds | 270/39 |
| 1,939,925 | 12/1933 | Schwartz | 83/100 X |
| 2,116,782 | 5/1938 | De Loye | 270/39 |
| 2,165,786 | 7/1939 | Christman | 493/418 X |
| 2,546,221 | 3/1951 | Funk | 83/100 X |
| 2,626,145 | 1/1953 | Sabee | 493/434 X |
| 2,761,676 | 9/1956 | Sabee et al. | 270/39 |
| 2,929,624 | 3/1960 | Brooker | 270/39 |
| 3,044,766 | 7/1962 | Banks | 493/434 X |
| 3,163,413 | 12/1964 | Franke et al. | 270/39 |
| 3,363,896 | 1/1968 | McKindary | 493/433 X |
| 3,490,762 | 1/1970 | Nystrand | 270/39 |
| 3,572,681 | 3/1971 | Nystrand | 270/39 |
| 3,829,080 | 8/1974 | Braen et al. | 270/39 |
| 3,883,131 | 5/1975 | Anderson et al. | 493/433 X |
| 4,070,014 | 1/1978 | Takahashi | 493/433 X |
| 4,163,548 | 8/1979 | Nystrand | 270/39 |
| 4,164,161 | 8/1979 | Slack | 83/100 |

FOREIGN PATENT DOCUMENTS

| | | | |
|---|---|---|---|
| 219396 | 6/1961 | Austria | 270/39 |

*Primary Examiner*—E. H. Eickholt

*Attorney, Agent, or Firm*—Wheeler Law Firm

[57] ABSTRACT

Apparatus for perforating Z-folding, and further processing long tissue webs to form stacks of Z-folded facial tissues or the like for being packaged in consumer boxes. In one embodiment, two webs are perforated and superimposed at the nip of counterrotating rolls so the perforations of one web are staggered between the perforations of the other web. The webs are Z-folded by vacuum adhering portions of the superimposed webs alternately to the portion of each roll below the nip, drawing the adhered portions back and forth out of the mutual tangent plane forming the nip to start Z-folds. The folds are creased by further means. A continuous stack of Z-folded tissues is formed and can be subdivided into counted stacks of tissue for packaging. In another embodiment, the webs are perforated and superimposed as before, and the web is then alternately directed to first and second folding stations, each of which includes a counterrotating pair of folding rolls which Z-fold the superimposed webs in essentially the same manner as the perforating roll of the first embodiment. When a predetermined length of the superimposed webs has been Z-folded by one folding station, the superimposed webs are transferred to the other folding station. An elevator mechanism associated with each folding station conveys each finished stack away, then returns to receive the next stack to be folded at that station.

15 Claims, 27 Drawing Figures

TISSUE CUTTING AND INTERFOLDING APPARATUS FOR Z WEBS

CROSS-REFERENCE TO RELATED APPLICATIONS

This specification is a continuation-in-part of an U.S. patent application Ser. No. 246,053, filed Mar. 20, 1981 by the present inventors and now abandoned.

BACKGROUND OF THE INVENTION

The invention relates to an apparatus for superimposing and Z-folding two webs of tissue to form stacks of facial tissues for being packaged in consumer boxes.

Prior methods and apparatus for cutting and Z-folding tissue sheets are shown, for example, in Sabee U.S. Pat. No. 2,626,145. In such apparatus two continuous separate webs of tissue are perforated transversely at regular intervals in such a manner as to leave periodic tear lines in each web. The bonds of the sheets at the tear lines must be quite weak so as to be easily broken upon the exertion of a small amount of force, such as by pulling one of the stacked and interfolded tissues through the restricted opening of a dispensing box. The two webs with tear lines are superimposed in staggered relation so the tear lines of each web are positioned between the tear lines of the other web.

The superimposed webs are then Z-folded opposite each tear line so each tear line of each web is tucked into a fold of the other web. Each fold is effected by a pair of jaws and a tucker mounted on the respective sides of the superimposed webs. The tucker forces the superimposed webs between the jaws, the jaws close to capture and fold the web, the jaws carry the web to the discharge area, they open, and the interfolded tissue is released. One pair of jaws is located on each side of the web, and the pairs of jaws operate alternately on the superimposed webs to effect Z-folding.

The mechanical clamping of the sheet by the known jaws causes a sharp crease in the web and often severs it. The sheets are marred where the jaws seize the product.

Further, because of the large number of mechanical operations being performed in a given length of time by the rapidly opening and closing jaws, the speed of this type of interfolding machine is limited. At high speeds the jaws cannot be opened fast enough and the sheet can tear. The interfolded web also is not transported away from the interfolding station fast enough to allow interfolding to be performed at a high rate of speed.

SUMMARY OF THE INVENTION

This invention is an improved Z-folding machine in which interfolding is accomplished by vacuum adhering portions of the superimposed webs alternately to one or the other of a pair of folding rolls which form a nip, rotating the adhered roll to advance the adhering region in the machine direction and out of the tangent plane of the nip, thereby starting a fold, and then releasing the adhering portion of the web. The fold can then be creased by tamping fingers. The superimposed webs can be trained together on the folding rolls because the thin tissue sheets being processed have high permeability. The rolls are staggered or out of phase by one-half of the length of one unfolded tissue to allow the vacuum means to come into play alternately.

In a first preferred embodiment, the webs are perforated to form tear lines, superimposed, and Z-folded by a single pair of counterrotating rolls between which the webs are trained. In this embodiment the Z-folded tissue is formed and conveyed from the site of formation as a single stack which can be divided into consumer sized stacks for packaging.

In a second preferred embodiment the webs are perforated, superimposed, and directed to one of two folding stations by one pair of counterrotating rolls. These rolls are equipped to periodically sever the superimposed webs and redirect their resulting leading edges from one folding station to the other, thereby allowing discrete, precounted stacks of Z-folded tissues to be formed at the folding stations alternately. Each Z-folding station can operate substantially like the Z-folding means of the first embodiment.

In the second embodiment, each discrete stack can be supported on a usually stationary conveyor belt which is lowered by an elevator to accomodate the stack as it is formed. When the stack is complete the elevator's conveyor belt can be operated to advance the stack to further conveying means. The elevator can then be raised into position to receive, support, and lower the next stack as it is formed.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. While the best known embodiment has been described, the details may be changed without departing from the invention, which is defined by the claims.

Figure 1:
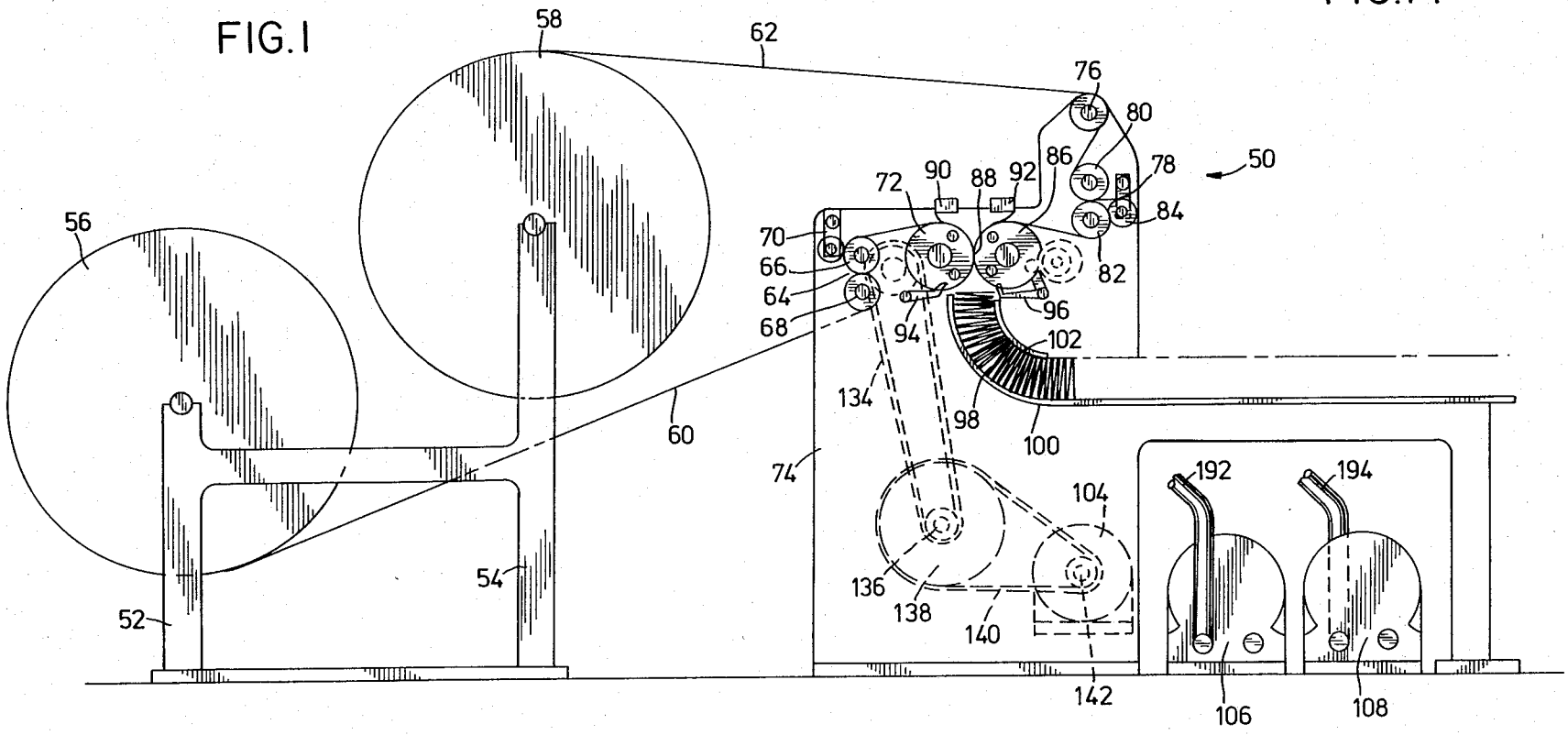
FIG. 1 is a schematic cross-machine direction elevational view of one embodiment of the invention.

FIG. 1 shows the primary elements of a first embodiment of the invention, in which the respective webs are perforated, superimposed, and folded by a single pair of perforating and folding rolls. The interfolding machine indicated by reference character 50 comprises stands 52 and 54 for supporting parent rolls 56 and 58 to allow webs 60 and 62 of tissue to be drawn in substantially continuous fashion during a folding operation. Rolls 56 and 58 are driven in the usual manner to facilitate drawing the respective webs from them. Web 60 is conveyed through the nip 64 of a belt driven pair of draw rollers 66 and 68 (the belts and pulleys are not shown). A slitting head 70 divides the web into a series of strips, each one product wide. The web is then received on first perforating and folding roll 72, which is further described below. Rollers 66, 68, slitting head 70, and first perforating and folding roll 72 are all carried on a stationary frame 74. Web 62 is directed over the perforating rolls by guide roller 76 and is similarly passed through a nip 78 defined by draw rollers 80 and 82, is slit by a slitting head 84, and is conveyed to a second perforating and folding roll 86 which forms a nip 88 with first perforating and folding roll 72. Also identifiable in FIG. 1 are fixed knife assemblies, respectively 90 and 92, associated with each perforating and folding roll; tamping fingers 94 and 96 and the associated mechanism for completing folds in the web; a Z-folded web portion 98 confined between the sidewalls 100 and 102 of a fixed conduit; the drive motor 104 which powers all the moving parts (the connections to some of which are not shown); and vacuum pumps 106 and 108 which assist in transporting and folding the web, as will be seen presently.

Figure 2:
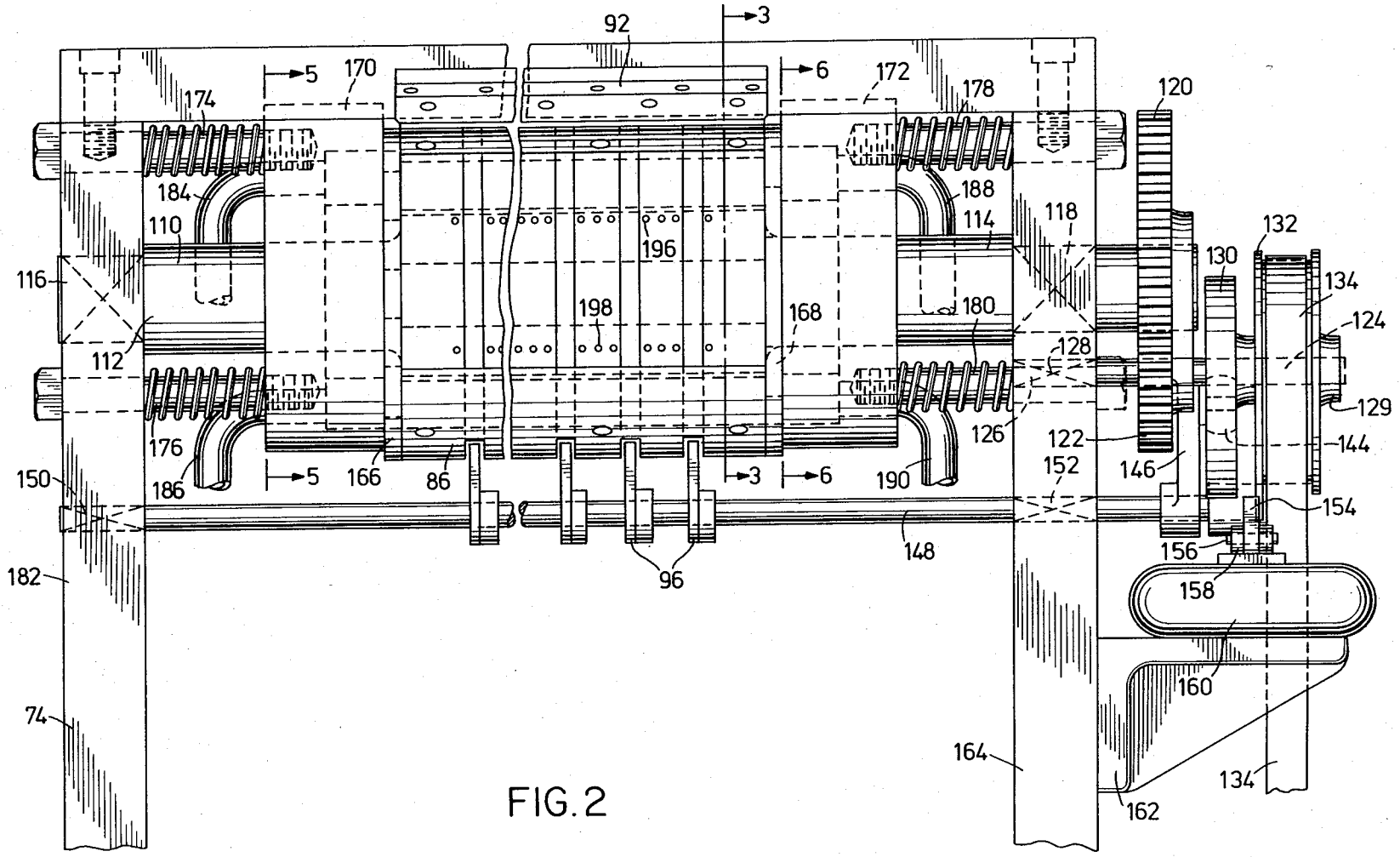
FIG. 2 is an enlarged fragmentary contra-machine direction elevational view of the structure shown in FIG. 1.
Figure 3:
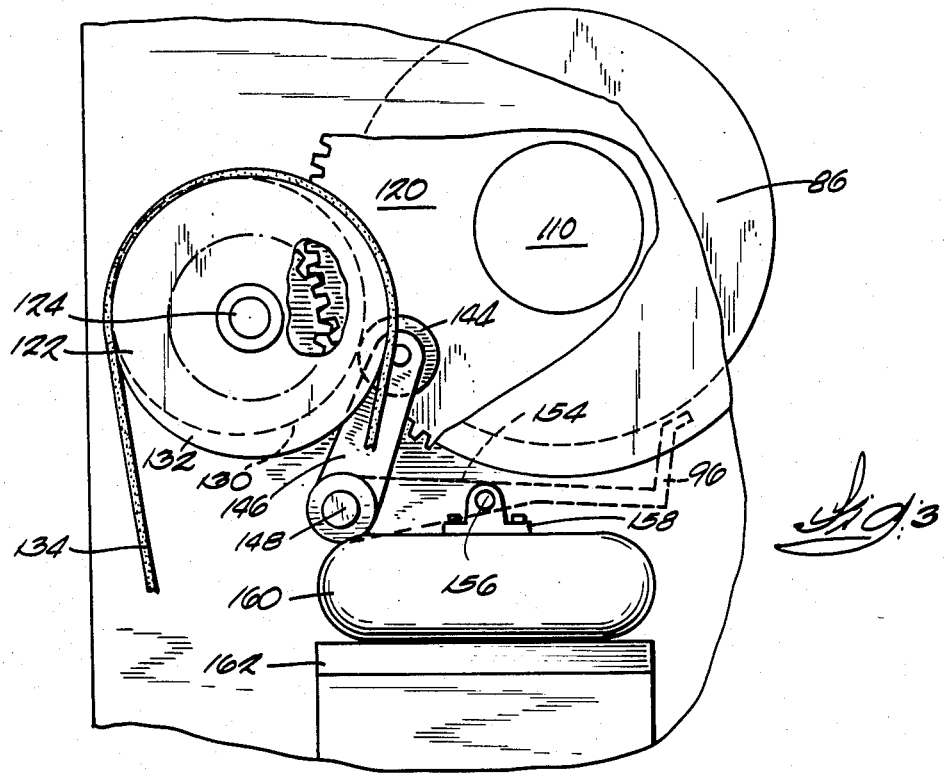
FIG. 3 is a cutaway fragmentary righ side elevational view of the structure of FIG. 2, further illustrating the gearing shown in FIG. 2.

Turning now to FIGS. 2 and 3, some of the drive and carriage elements for the perforating roll 86 and tamping fingers 96 are illustrated. Second perforating roll 86 is mounted on a shaft 110, the respective ends 112 and 114 of which are received in rotation bearings 116 and 118 to support roll 86 for rotation. A spur gear 120 is keyed to an extension of end 114 of shaft 110 and is meshed with pinion 122. The drive ratio between spur gear 120 and pinion 122 is 3 to 1. Pinion 122 is keyed to a shaft 124 having a first end 126 received in a rotation bearing 128 and a second end 129 received in another rotation bearing (not shown). A cam 130 and timing belt sprocket 132 are keyed to shaft 124 and driven by a timing belt 134. Returning briefly to FIG. 1, timing belt 134 is turned by sprocket 136 fixed to a sprocket 138, which in turn is driven by timing belt 140 driven by a sprocket 142 connected to motor 104. Thus, cam 130 is driven at one angular velocity and roll 86 is driven at an angular velocity one third as great, this relation remaining constant at all times.

Returning to FIGS. 2 and 3, cam 130 is associated with a cam follower roller 144 rotatably mounted to a cam follower arm 146 keyed to a shaft 148 which is carried by bearings 150 and 152 for rotation. A series of tamping fingers 96 as previously described are keyed to shaft 148 and thus rock back and forth to effect tamping, the reason for which is further explained below. Roller 144 is urged against cam 130 by a bell crank having a first arm defined by cam follower arm 146 and a second, generally horizontally extending arm 154 which receives a pin 156 carried by clevis 158. An air spring 160 carried between clevis 158 and a stationary member 162 fixed to member 164 of frame 74 is inflated by air pressure means (not shown) to keep roller 144 in contact with cam 130. Thus, tamping fingers 96 move according to the travel of cam follower arm 146 as the cam is rotated.

FIG. 2 also shows fixed knife assemblies 92, blanking discs 166 and 168 mounted to rolls 72 and 86, and nonrotating vacuum shoes 170 and 172 which are mounted on spring loaded studs 174, 176, 178, and 180 slidably received by frame elements 164 and 182 for being urged against rotating blanking discs 166 and 168. Conduits 184, 186, 188, and 190, the former two of which are branches of conduit 192 (FIG. 1) and the latter two of which are branches of conduit 194 (FIG. 1), connect vacuum shoes 170 and 172 to vacuum pumps 106 and 108. FIG. 2 also illustrates that the perforating rolls are provided with periodic circumferentially disposed grooves which allow tamping fingers 96 to be recessed slightly into the perforating rolls to aid their function.

Furthermore, FIG. 2 illustrates rows such as 196 and 198 of suction conduits which communicate respectively with shoes 170 and 172 for securing portions of the webs to the rolls, as further explained below.

Figure 4:
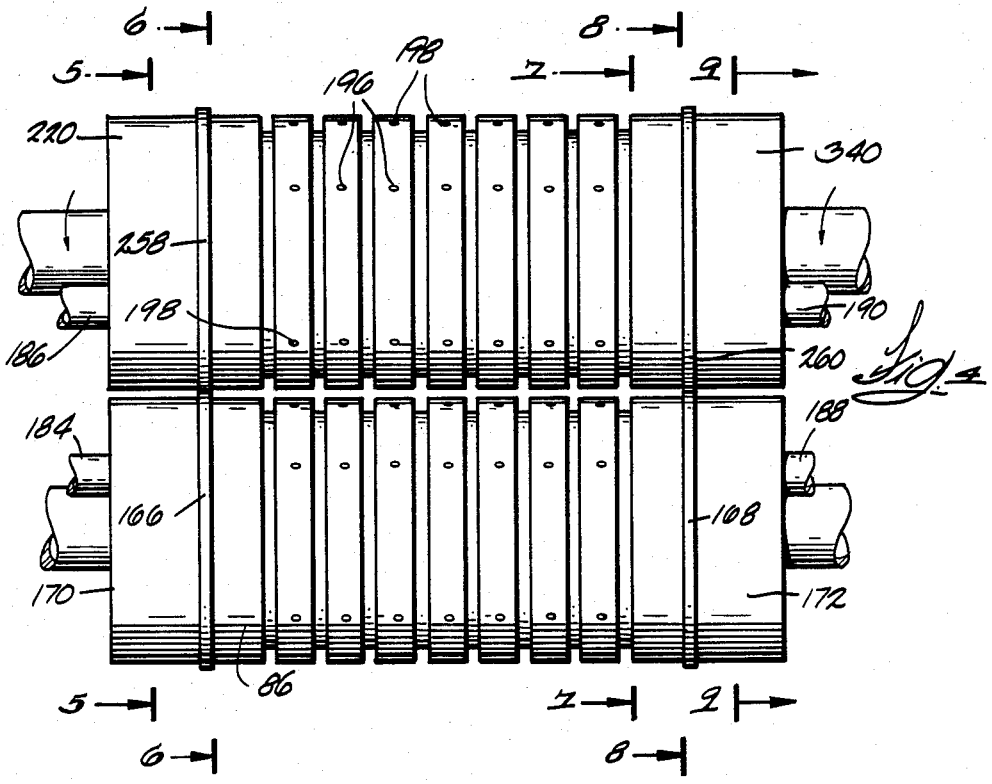
FIG. 4 is an enlarged schematic top plan view of the pair of perforating and folding rolls shown in FIG. 1.
Figure 5:
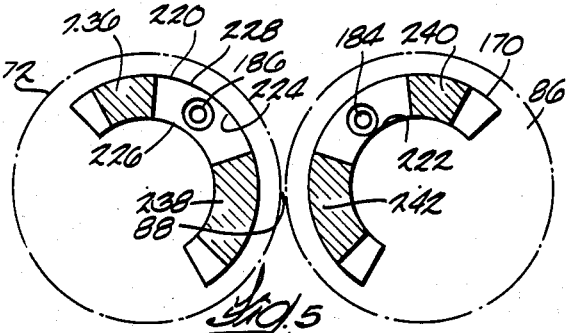
FIG. 5 is a sectional view taken along line 5—5 in FIG. 4, showing the stationary vacuum manifolds for assisting transport of the webs into the nip formed by the perforating and folding rolls.

FIGS. 4 through 13 show in more detail the manner of communication between vacuum pumps 106 and 108 and the vacuum ducts on the roll surface. Referring first to FIG. 5 showing a schematic sectional view of the vacuum shoes and FIGS. 10 through 12 (which are enlarged and more detailed views of isolated parts), vacuum shoe 170 of folding and perforating roll 86 and the corresponding vacuum shoe 220 of folding and perforating roll 72 respectively comprise stationary arcuate channels 222 and 224 having concentric sidewalls 226 and 228 and flat sidewalls 230. Conduit 186 is received in a bore 234 in sidewall 230, thus placing it in communication with the interior of channel 224.

The region of channel 224 in communication with conduit 186 of shoe 220 is reduced and defined by gate blocks 236, 238, 240, and 242, each an arcuate solid which completely blocks the portion of the channel 222 or 224 within which it resides, and each slidable along the channel to change the effective circumferential length of the open part of the channel. Each gate block such as 236 or 238 is provided with a threaded bore such as 244 in FIG. 12 for receiving machine screws 246, 248. The noted machine screws have shanks 250 and 252 which are unthreaded, and which are respectively received in circumferentially disposed slots 254, 256 in sidewall 230. When the machine screws are threaded completely into a threaded bore such as 244 the block such as 236 and the head of the associated screw such as 246 bear against the respective sides of sidewall 230 and secure the block in place. When the screw such as 246 is loosened, the block such as 236 can be slid within channel 224 as far as slot 254 permits. This feature allows precise adjustment of the dimensions of the open portion of channel 224.

FIG. 5 illustrates that the open portions of channels 222 and 224 are disposed above nip 88, so the ends of rolls 72 and 86 pass over the respective channels before passing into the nip region. Vacuum shoes 170 and 220 thus assist in training the respective webs 60 and 62 onto perforating and folding rolls 72 and 86.

Figure 6:
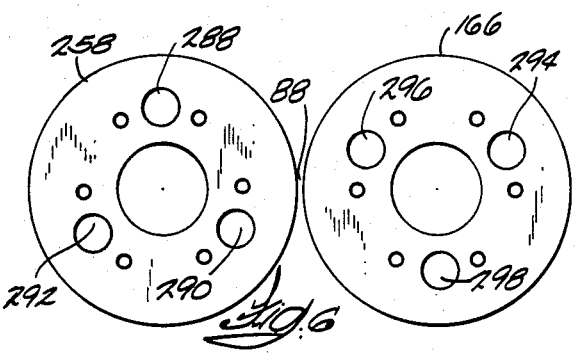
FIG. 6 is a sectional view taken along line 6—6 in FIG. 4, showing the blanking discs secured to one end of each perforating and folding roll.
Figure 7:
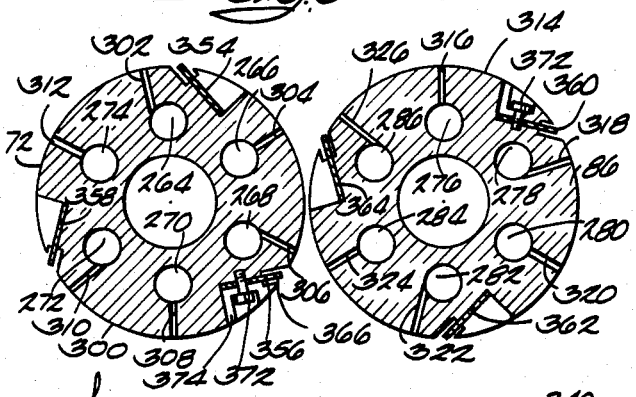
FIG. 7 is a sectional view taken along line 7—7 in FIG. 4, showing the construction of the perforating rolls.
Figure 8:
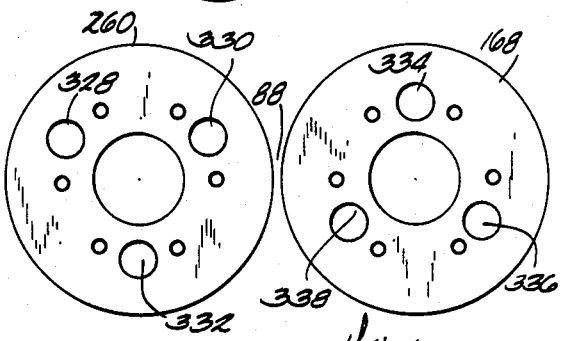
FIG. 8 is a sectional view taken along line 8—8 in FIG. 4, showing the blanking discs secured to the other end of each perforating roll.
Figure 15:
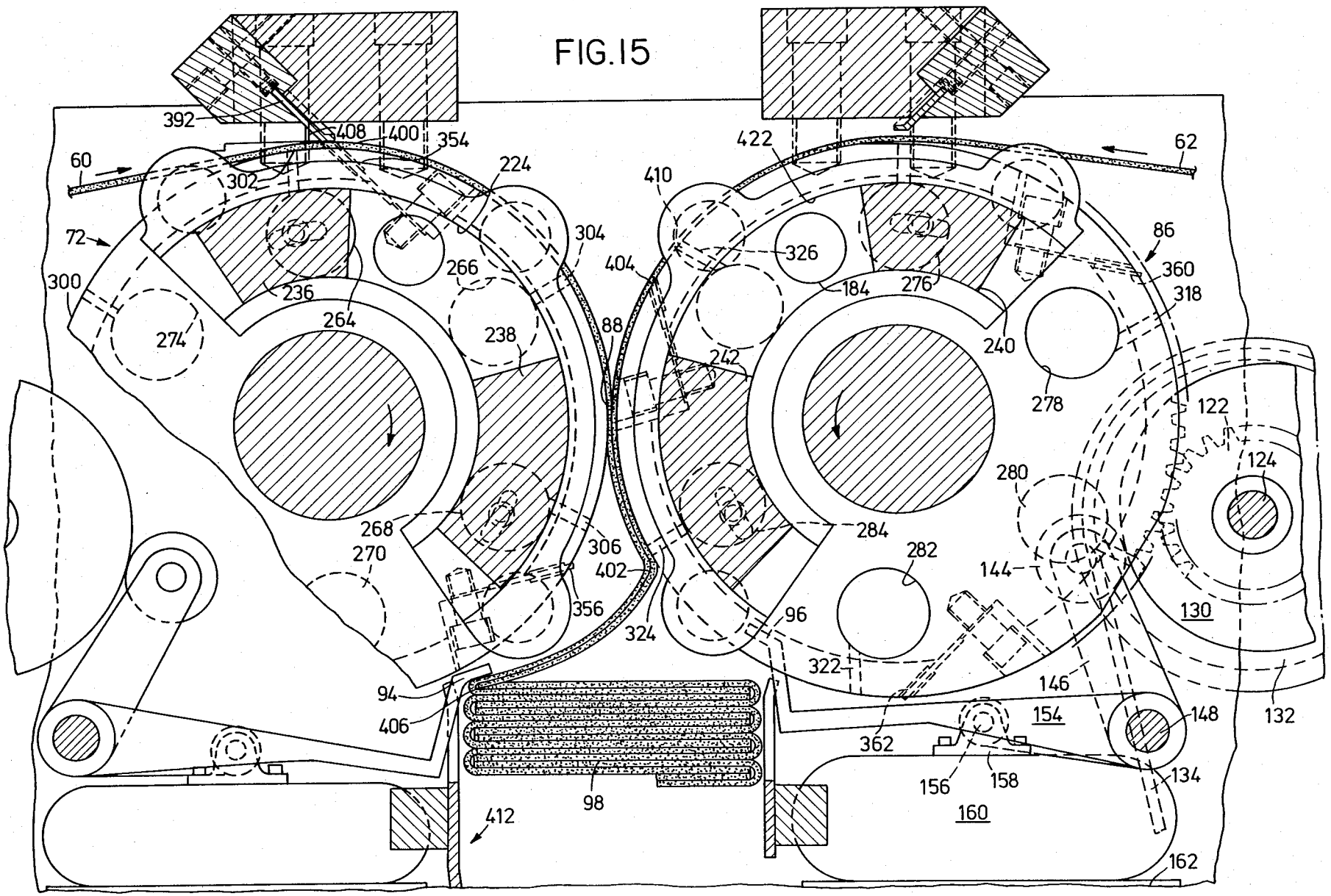
FIG. 15 is a fragmentary machine direction sectional view similar to FIGS. 1 and 5–8, showing several superimposed sections of the perforating and folding rolls and emphasizing the manifolds for transporting the webs into the nip.

FIG. 6 shows the sectional construction of blanking discs 166 and 258 of the respective rolls; FIGS. 7 and 15 show the corresponding sectional configuration of rolls 72 and 86; and FIG. 8 shows the blanking discs 168 and 260 fastened to the other ends of the respective folding and perforating rolls. Roll 72 has a uniform cross-section along its entire axial length and includes axially disposed, circumferentially spaced bores 264, 266, 268, 270, 272, and 274. Roll 86 has corresponding bores 276, 278, 280, 282, 284, and 286.

In this embodiment the folding and perforating rolls 72 and 86 are three up, meaning that the circumferences of rolls 72 and 86 are equal to the combined machine direction length of three tissues. The six bores in each perforating roll are spaced sixty degrees apart so that there are two bores for each tissue entrained on the roll.

Blanking disc 258 is superimposed on and secured to one end of roll 72 and includes bores 288, 290, and 292 spaced one hundred twenty degrees apart and respectively registered with bores 264, 268, and 272 of roll 72. Blanking disc 258 blocks off the near ends of bores 266, 270, and 274. As vacuum shoe 220 forms a rotating seal with blanking disc 258, blanking disc 258 thus allows communication between channel 224 and one of bores 264, 268, and 272 whenever a bore and the channel are registered.

Blanking disc 166, secured to roll 86 and disposed beside blanking disc 258, similarly has bores 294, 296, and 298 spaced one hundred twenty degrees apart and superimposed on bores 278, 282, and 286 of roll 86 to permit communication between vacuum shoe 170 and those bores, while blocking off one end of bores 276, 280, and 284. It will be noted that channels 222 and 224 would communicate with corresponding bores in the respective perforating rolls at the same times if the rolls were in phase, but the perforations of blanking disc 258 are offset by 60 degrees from the corresponding bores of blanking disc 166.

The bores of roll 72 communicate with its outer surface 300 via rows of ducts such as 302, 304, 306, 308, 310, and 312, and the bores of roll 86 communicate with its outer surface 314 via rows of ducts such as 316, 318, 320, 322, 324, and 326. Ducts 302, 306, and 310 of roll 72 are shifted circumferentially with respect to the corresponding bores, forming the previously identified rows 196 which periodically communicate with channel 224, but never with channel 344. Similarly, circumferentially shifted or off-centered ducts 318, 322, and 326 of roll 86 communicate (via bores 278, 282, and 286 in roll 86 and bores 294, 296, and 298 in blanking disc 166) with channel 222. Ducts 304, 308, and 312 of roll 72 and ducts 316, 320, and 324 of roll 86, which are centered on the corresponding bores, do not ever communicate with channels 222 and 224. By comparing the respective rolls in FIG. 7, it will be seen that the circumferentially shifted ducts 302, 306, and 310 are sixty degrees out of phase with the corresponding circumferentially shifted ducts 318, 322, and 326 of the other roll. Since channels 222 and 224 are in phase, this means that vacuum will be alternately served from those channels to the off-centered ducts of the respective rolls 72 and 86.

FIGS. 4, 7, 8, and 9 illustrate the means for serving vacuum to the radially centered ducts 304, 308, 312, 316, 320, and 324 shown in FIG. 7. FIG. 4 illustrates that blanking discs 260 and 168 are mounted respectively on rolls 72 and 86. The bores 328, 330, and 332 of blanking disc 260 shown in FIG. 8 are superimposed over bores 266, 270, and 274 of roll 72 shown in FIG. 7, while bores 264, 268, and 272 of roll 72 are blocked off by blanking disc 260. Similarly, blanking disc 168 mounted on folding and perforating roll 86 includes bores 334, 336, and 338, respectively superimposed on bores 276, 280, and 284 and blocking off the other bores.

Figure 9:
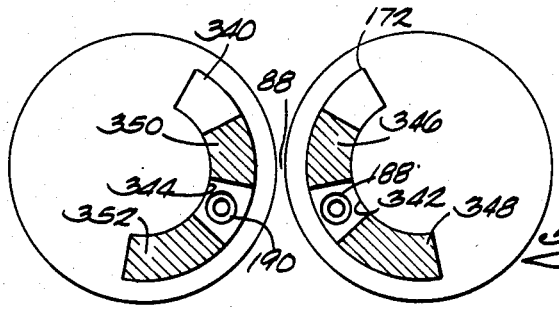
FIG. 9 is a sectional view taken along line 9—9 in FIG. 4, showing the stationary vacuum manifolds for assisting transport of the webs out of the nip formed by the perforating roll.
Figure 12:
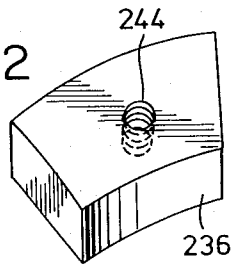
FIG. 12 is a perspective view of one of the vacuum blocks found in the manifolds of FIGS. 10 and 11.
Figure 13:
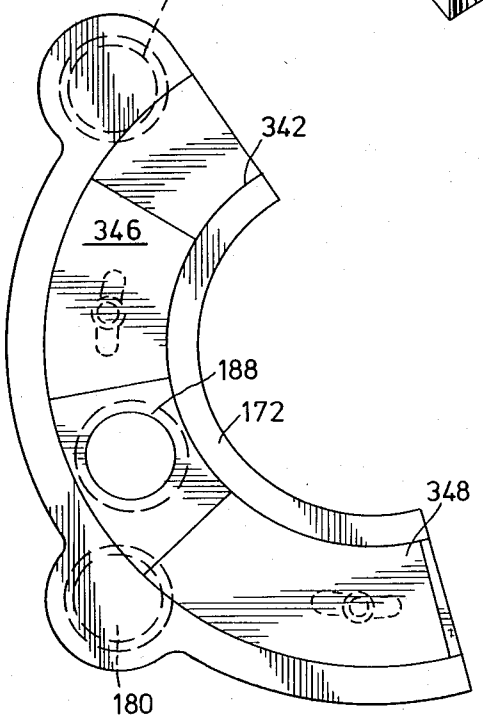
FIG. 13 is a more detailed partial sectional view similar to FIG. 9, showing one manifold.
Figure 10:
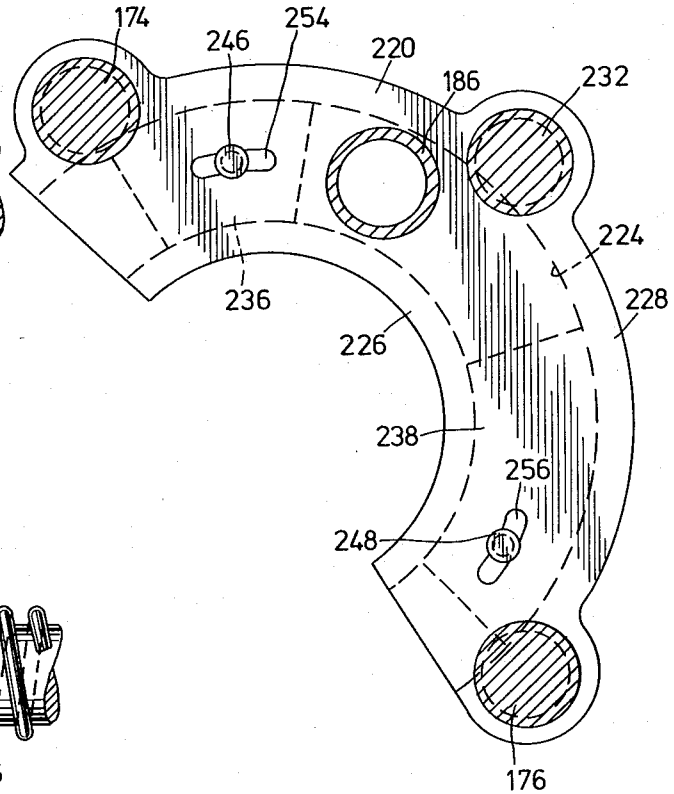
FIG. 10 is a more detailed partial sectional view similar to FIG. 5, showing one manifold.
Figure 11:
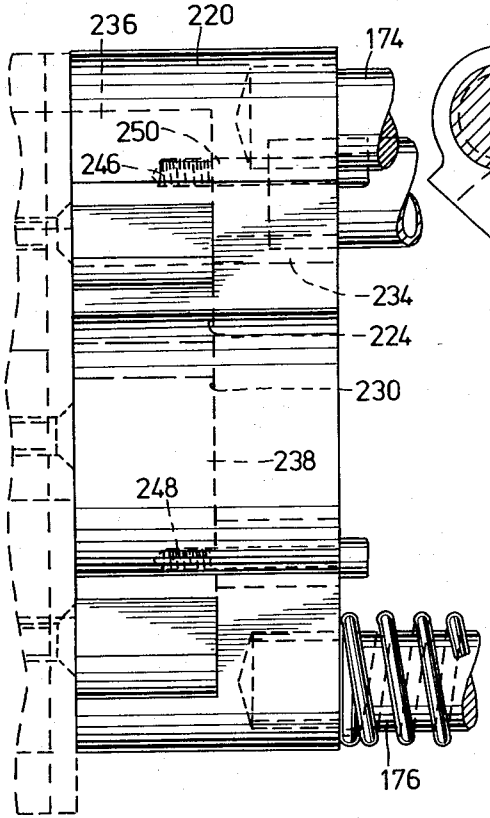
FIG. 11 is a fragmentary side elevational view of the manifold shown in FIG. 10.

FIGS. 9 and 13 illustrate that vacuum shoes 172 and 340 periodically communicate between vacuum conduits 188 and 190 (via blanking discs 260 and 168) and each of the bores within the perforating and folding rolls. Vacuum shoes 172 and 340 are essentially identical in construction to vacuum shoes 170 and 220, except that the space bounded by channels 342, 344, and gate blocks 346, 348, 350, and 352 is disposed just below nip 88 so communication between conduits 188, 190 (via the respective blanking discs) with passages 266, 270, and 274 and passages 276, 280, and 284 starts about at nip 88 and continues therefrom. The gate blocks are again adjustable circumferentially to regulate the zone in which vacuum is applied to ducts 304, 308, 312, 316, 320, and 324.

Figure 14:
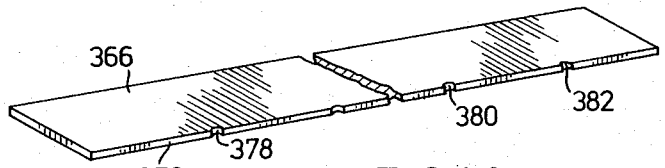
FIG. 14 is a perspective view of one of the perforating knives shown in numerous other figures.

Another feature, shown in FIGS. 7, 14, and 15, is the provision of moving perforating knives 354, 356, and 358 of roll 72 and 360, 362, and 364 of perforating roll 86. The knife assemblies, only two of which are shown in detail in FIG. 7, each include a blade 366 which is clamped into rolls 72 and 86 by wedge 374. Bolts 372, recessed into a wedge 374 and threaded into the body of the perforating and folding roll, hold wedge 374 in place. Clearance is provided between wedge 374 and the working edge of the blade, and between the working edge of the blade and roll 72 or 86, thus provide a live blade. Blades such as 366 cooperate with the fixed blades 90 and 92 (see also FIG. 2) secured to the frame to perforate each portion of each web that is caught between the moving and fixed knives. Knife edge 376 is relieved by notches 378, 380, 382 and so forth to prevent the interaction of the moving and fixed knives from completely severing the web. Instead, transverse tear lines that include bridges are formed to assist in keeping the web aligned after perforation.

FIGS. 15 through 18 show the various elements of the respective folding and perforating rolls 72 and 86 and associated structures in more detail, to illustrate how the invention works.

FIG. 15 shows rolls 72 and 86 at the same orientation as they have in FIGS. 4 through 9. Web 60 is provided with tear lines at intervals of 120 degrees of rotation of roll 72 by the cooperation of knife assemblies 354, 356, and 358 (the latter is not visible in the figure) with stationary knife assembly 90 at the twelve o'clock position with respect to the roll. In FIG. 15, one tear line is being created at point 400, while the prior tear line was created at point 402 by cooperation of moving knife assembly 356 with knife assembly 90. As roll 86 is 60 degrees out of phase with roll 72 the tear lines 404 and 406 in web 62 are 60 degrees ahead of (or behind) the corresponding perforations identified in web 60. The webs, having been led onto the perforating and folding rolls and perforated at the indicated points, are secured to the respective rolls going into nip 88 at points 402, 408, and 410. Web 60 is secured by the vacuum drawn via duct 302 and bore 264; one end of bore 264 is shown just beginning communication with the open portion of channel 224 between gate blocks 236 and 238. It is only when some portion of bore 264 overlaps at least a portion of the open part of channel 224 that a vacuum is drawn at point 302. A similar restriction applies, for example, to duct 306, which draws no vacuum in FIG. 15 because its associated bore 268 is entirely obscured by gate block 238. Thus, each duct such as 302 for securing a portion of web 60 to roll 72 to carry it into nip 88 operates approximately from the position of duct 302 shown in FIG. 15 to a position in which duct 302 passes nip 88. The offset of duct 302 with respect to bore 264 is provided so duct 302 will pick up web 60 just behind a tear line 400, instead of directly at the tear line, so the leading edge behind each tear line is secured to the roll.

In connection with FIG. 15, which does not explicitly show the several blanking discs, it will be recalled that bores 266, 270, and 274 are isolated from channel 224 by blanking disc 258, while bores 276, 280, and 284 are isolated by blanking disc 166 from channel 222. Thus, since the operative vacuum ducts for either vacuum shoe are spaced one hundred twenty degrees apart on the roll, and since web 60 between one tear line 400 and the next tear line 402 spans one hundred twenty degrees of the roll surface, it will be evident that the web is adhered to the roll surface just behind each tear line, transported approximately to nip 88, and then released, and the same is true of the transport of web 62. The ducts offset with respect to their bores and the associated vacuum means thus are first transport means for supporting the web after tear lines are formed to ensure that neither of the webs is severed at the tear lines at this point.

Once the webs are fed into nip 88, they are superimposed. Since the section of each web between successive tear lines spans one hundred twenty degrees of roll surface, and since the rolls are sixty degrees out of phase, meaning any point on one roll passes through nip 88 sixty degrees ahead of or behind the corresponding point on the other roll, the webs are superimposed in this embodiment with the tear lines of one web exactly between the tear lines of the other web. It will be realized, however, that the tear lines of one web need not be centered on the tear lines of the other web in order to practice the present invention.

Once the webs are superimposed at point 88, the next step is to Z-fold them, which takes place on the region just below nip 88. FIG. 15 illustrates that Z-folding is accomplished by causing adherence of portions of the superimposed webs opposite the tear lines such as 402 of one web by the row of ducts such as 324 which are centered on the associated bore 284 in the roll. Since the ducts such as 324 and 304 of the respective rolls are offset by sixty degrees, which is the same as the angular separation between the tear line of one web and the immediately following tear line of the other web, the distance between succeeding folds is 60 degrees of roll travel. FIG. 15 does not illustrate the vacuum shoes 172 and 340 for selectively supplying vacuum to accomplish Z-folding.

Figure 16:
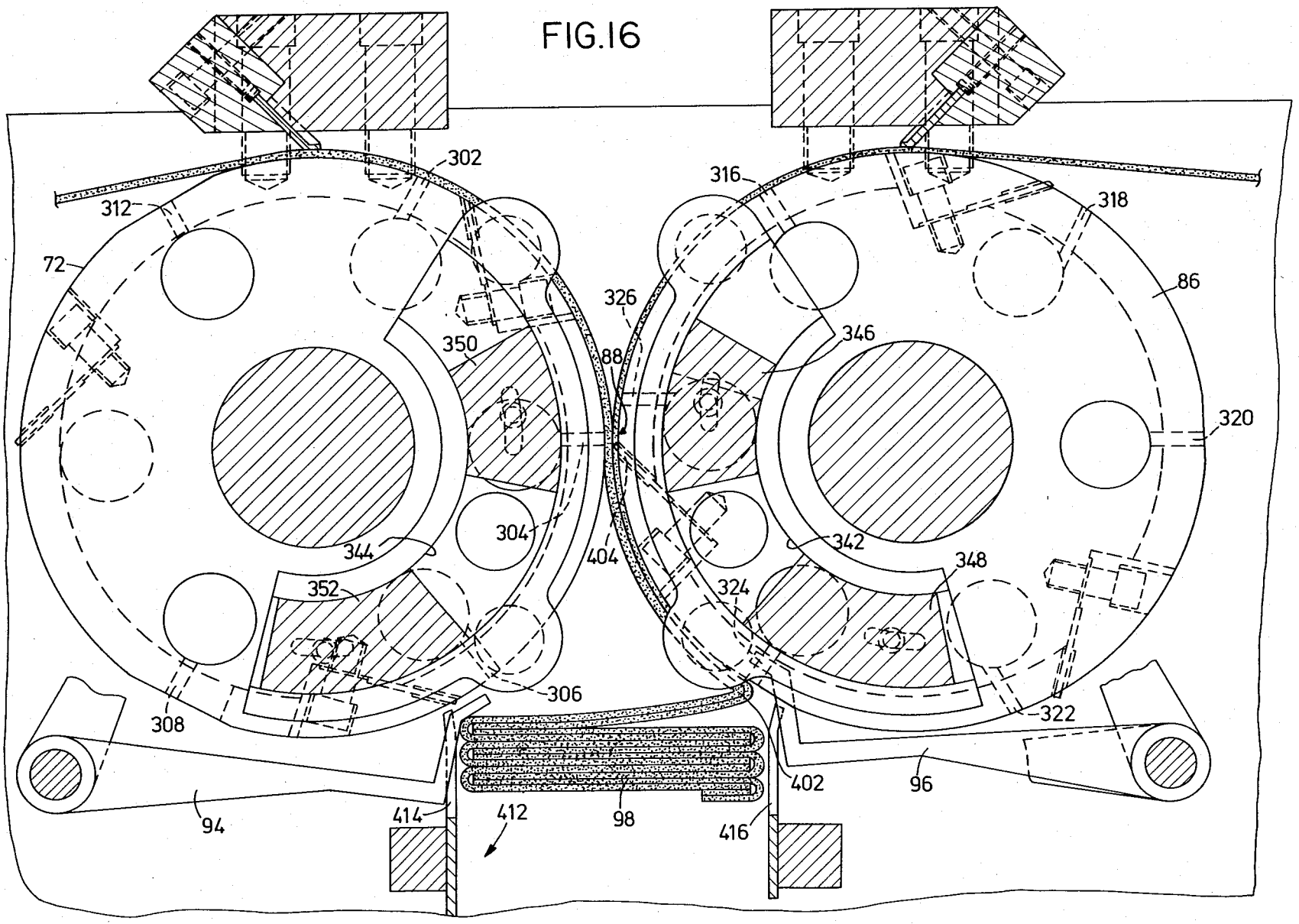
FIG. 16 is a view similar to FIG. 15, but showing the rolls rotated 30 degrees further and emphasizing the manifolds for transporting the webs out of the nip.
Figure 17:
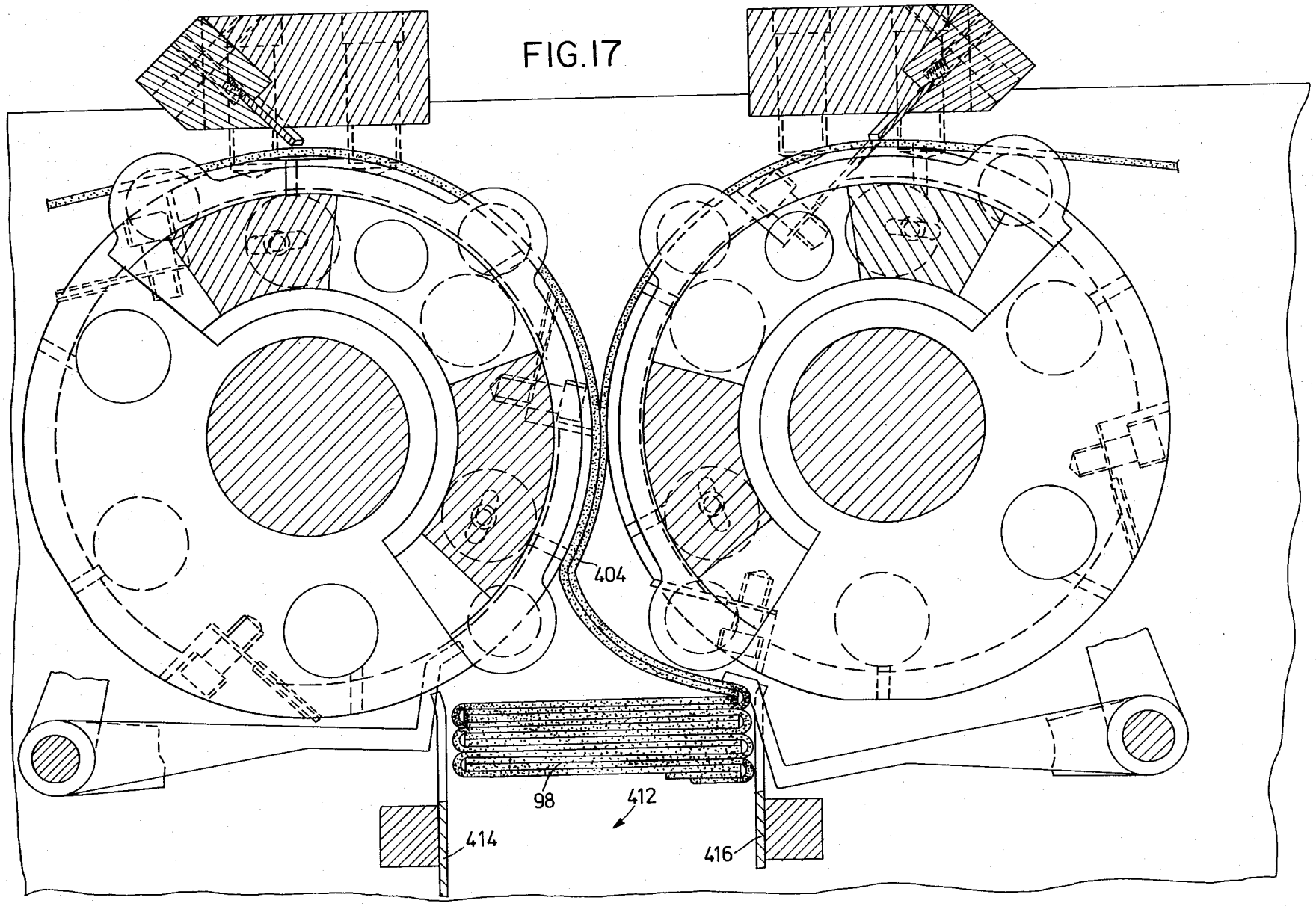
FIG. 17 is a view similar to FIG. 15, but showing the rolls rotated 60 degrees further, or 30 degrees further than shown in FIG. 16.
Figure 18:
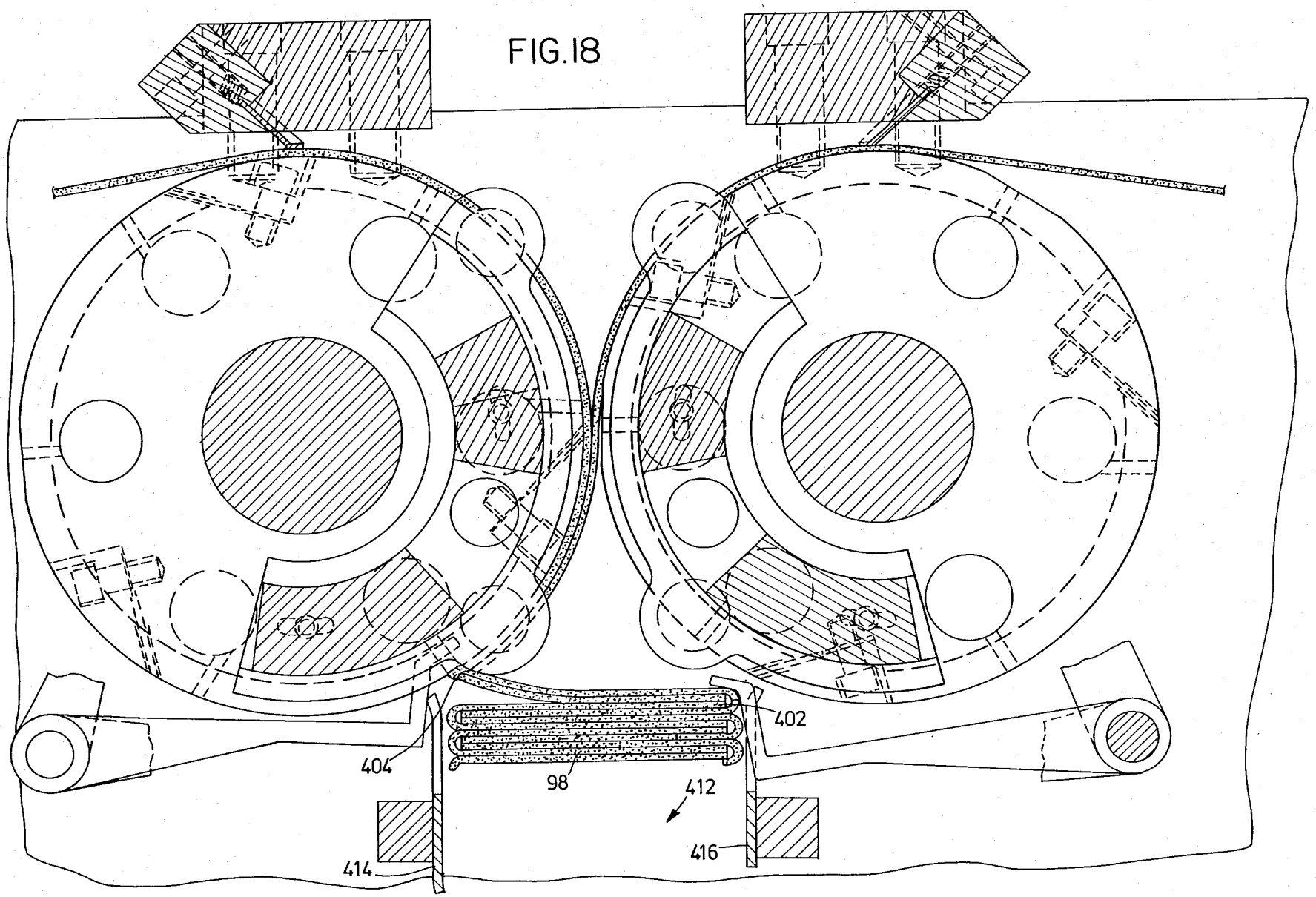
FIG. 18 is a view similar to FIG. 15, but showing the rolls rotated 90 degrees further, or 30 degrees further than shown in FIG. 17.

FIG. 16 shows that the channels 342 and 344, gate blocks 346, 348, 350, and 352, and blanking discs 168 and 260 only serve vacuum to centered ducts 312, 308, 304, 316, 320, and 324. The regions of intersection of the respective bores with the open portions of channels 342 and 344 are arranged so that each operative duct such as 304 is activated approximately at nip 88 and deactivated, as duct 324, at the completion of a fold. The superimposed webs are both picked up by a single vacuum duct, since the material being transported is permeable enough to allow the ducts to draw in the more distant web. The webs will be adhered to one or other of the rolls at sixty degree intervals so first the portion of the webs adjacent tear line 402 will be folded to the right as shown in FIG. 16, then the portions of the webs adjacent tear line 404 in nip 88 in FIG. 16 will be folded to the left as illustrated in FIGS. 17 and 18, and then the cycle will be repeated. Each fold is formed by securing a web portion to one roll and rotating that roll to transport the secured portion out of the nip and at the same time out of the plane of tangency defined by nip 88 to effect Z-folding. The Z-folded portion 98 of the superimposed webs is thus delivered to a mouth defined between walls 414 and 416 of a conduit 412 to receive the folded web, the respective walls presenting a friction surface which sufficiently resists the throughput of Z-folded web 98 to allow the web to be compressed. Tamping fingers such as 94 and 96, which are synchronized with the folding operation as explained before, extend into the grooves in each perforating roll when raised to receive a folded edge of the web and tamp the folded edge down, both to crease the fold and to advance the just folded portion of the web into conduit 412. As FIG. 1 illustrates, the web emerges from the other end of 412 as a continuous folded web.

FIGS. 15, 16, 17, and 18 show advancement by successive thirty degree steps, so the complete one hundred twenty degree cycle is illustrated by these four figures. After the situation as shown in FIG. 18 is observed, the cycle repeats itself as shown in FIGS. 15 and following.

Figure 19:
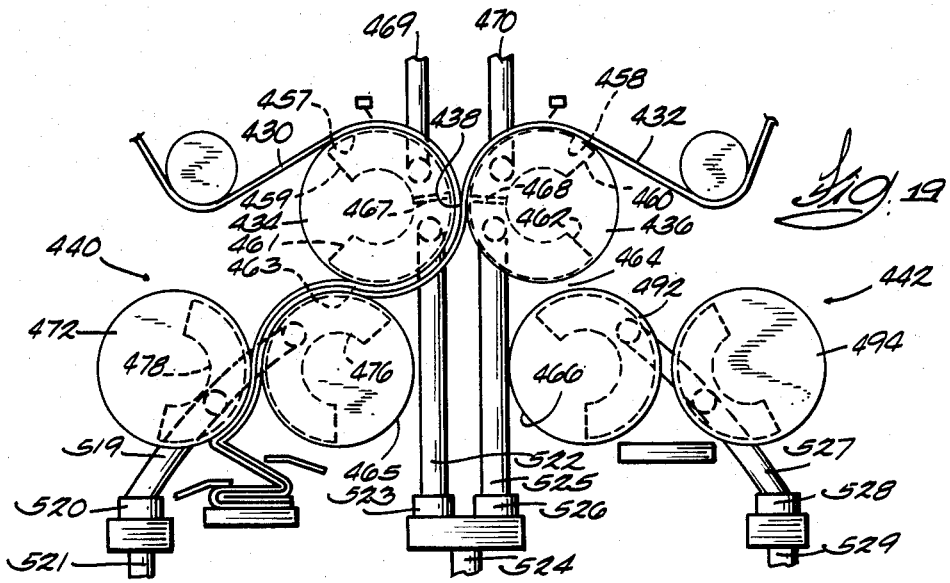
FIG. 19 is a diagramatic fragmentary side elevational view similar in viewpoint to FIG. 1, but showing the perforating rolls and folding stations of an alternate embodiment of the invention.
Figure 20:
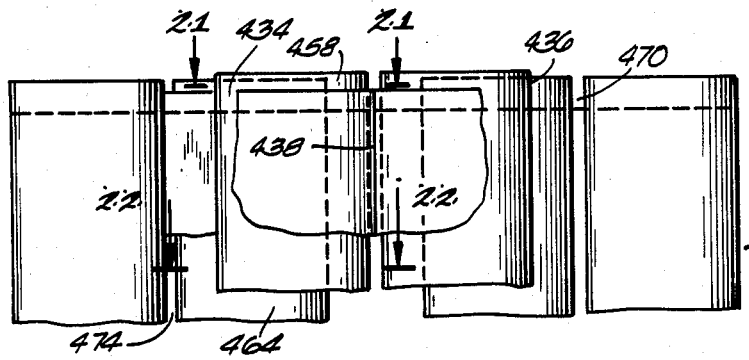
FIG. 20 is a diagramatic fragmentary top plan view of the rolls of FIG. 19, with parts cut away to show underlying structure.

FIGS. 19 and following illustrate an alternate embodiment of the invention in which the webs are perforated and superimposed by a first pair of rolls meeting at a nip, and then are conveyed to one of two folding stations, each defined by two folding rolls, for drawing the web back and forth as previously described to form Z-folds. The perforating rolls include means to direct the superimposed webs alternately to one or the other of the folding stations, severing the superimposed webs each time they are redirected.

Figure 21:
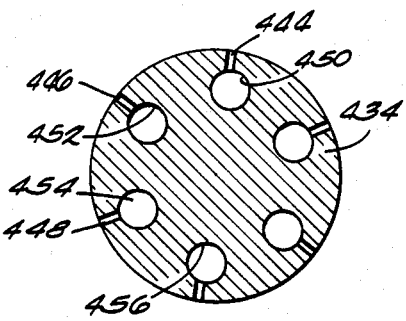
FIG. 21 is a cross-sectional view taken along line 21—21 of FIG. 20.

Referring first to FIG. 19, webs 430 and 432 are fed to superimposing and perforating rolls 434 and 436, perforated, and carried to nip 438 as described for the other embodiment. Then the webs are led away to one of two folding stations 440 and 442. One important difference between the embodiment of FIG. 19 and the previously described embodiment is that in the embodiment of FIG. 19 the roll ducts are not staggered. Instead, ducts 444, 446, 448, etc. of roll 434 come into registration with the corresponding ducts of roll 436 at nip 438. A second important difference, also illustrated in FIG. 21, is that the several ducts are centered on the bores 450, 452, 454, 456, etc., not offset with respect to the bores as in the previous embodiment. Third, the vacuum shoe arrangement for rolls 434 and 436 is somewhat different in this embodiment. Vacuum shoes 457 and 458 extend from end walls 459, 460 before the cite of perforation to end walls 461, 462 which follow the site of nips 463, 464 between the respective perforating rolls and folding rolls 465, 466. Vacuum shoes 457 and 458 are partitioned by internal walls 467, 468 disposed substantially at the site of nip 438. The upper portions of vacuum shoes 457 and 458, disposed above walls 467 and 468, communicate with a source of vacuum at all times via conduits 469 and 470. But only one of the lower portions of vacuum shoes 457 and 458, disposed below walls 467 and 468, is served with vacuum at a given time. The vacuum in these lower portions is shifted from one shoe to the other to break the webs and transfer the subsequent leading edges to the other folding station. Switching is performed by a solenoid valve in each vacuum line. The effect of these several differences will be further explained below, when the operation of the perforating rolls is described.

Figure 22:
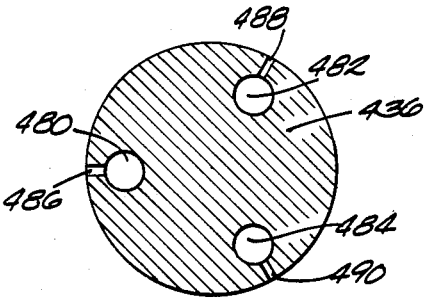
FIG. 22 is a cross-sectional view taken along line 22—22 of FIG. 20.

Turning now to folding station 440, it comprises counterrotating folding rolls 465 and 472 which meet at a nip 474. Roll 472 and roll 465 respectively turn clockwise and counterclockwise, thereby feeding superimposed webs 430 and 432 through nip 463 and into nip 474. As will be evident from FIG. 19, the vacuum shoe 476 of roll 465 extends all the way from just before nip 463 to the region beneath nip 474 where folding takes place. Vacuum shoe 476 is considerably greater in angular extent than vacuum shoe 478 because shoe 476 takes up the superimposed webs from roll 434 and also contributes to folding, while vacuum shoe 478 is provided only to participate in folding. Rolls 472 and 465 each have an internal cross-section as shown in FIG. 22, comprising three bores—480, 482, 484—spaced 120 degrees apart. Ducts 486, 488, and 490 are radially centered on the respective ducts. The bores and ducts of roll 465 are staggered 60 degrees with respect to the corresponding structures of roll 472, so when each duct reaches nip 474 it falls between the nearest ducts of the other roll. Thus, the functions performed by a single pair of rolls in the earlier embodiment are here performed by four adjacent rolls which meet at three different nips. Either one of the folding stations is in use at a given time and the other is inactive.

Two folding stations, 440 and 442, are provided in the embodiment shown in FIGS. 19 and following because the superimposed webs 430 and 432 are alternately conveyed to folding station 440 and to folding station 442, the shifts occuring periodically so the operating folding station will fold a predetermined number of tissues into a stack. When one folding station is inactivated, folding is continued by the other folding station so that the completed stack at the former station can be conveyed away and the former folding station can be returned to its starting position for being reactivated when the other folding station completes a stack. The superimposed webs are directed to one folding station or the other by providing four independently controlled vacuum supply means: one each for the lower portion of shoes 457 and 458 of perforating rolls 434 and 436, a third for the folding rolls 465 and 472 of station 440, and a fourth for the folding rolls of station 442.

Figure 23:
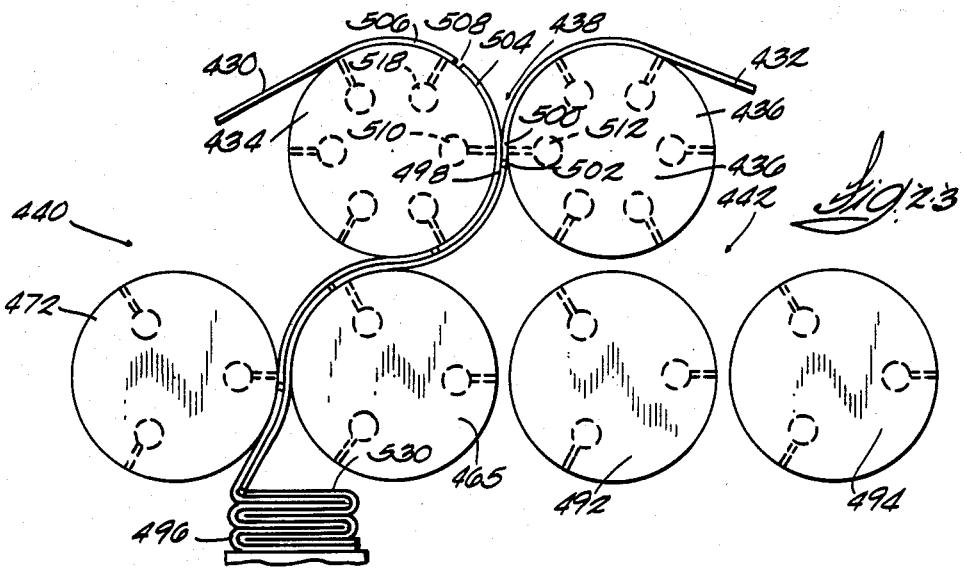
FIG. 23 is a diagramatic sectional view of the perforating rolls, two folding stations, and folded stack conveying means for the alternate embodiment of the invention, illustrating the situation just before the webs are severed and redirected to the other folding station. Web thickness is exaggerated for clarity.

FIG. 23 shows the situation when the final tissues for forming a precounted stack 496 are passing through nip 438. Because the tissues of web 430 and of web 432 are staggered, and since it is undesirable to provide undersized first or final tissues for either stack, it is important to separate leading and following edges of each web at a perforation line. Thus, web 432 should be severed at a regular perforation 502 to form a trailing end 498 to be processed at folding station 440 and a leading edge 500 to be transferred to folding station 442. Web 430 should be severed into a trailing end 504 and a leading end 506 at a regular perforation 508 thereof. While stack 496 is being formed, vacuum is served to the ducts of rolls 434, 465, and 472 and to the ducts of roll 436 from before the perforating station to nip 438, and is not being served to the ducts of roll 436 below nip 438 or to any duct of rolls 492, and 494. As a result, the superimposed webs are being conducted to folding station 440 and folded there.

Exactly when the tear line of web 432 to be severed in preparation for feeding the resulting leading edges to folding station 442 passes through nip 438, as in FIG. 23, the ducts corresponding to bores 510 and 512 contact webs 430 and 432 right behind the perforation 502 of web 432 which is to be severed to separate leading and trailing edges 500 and 498. The vacuum then is still being served to the ducts of roll 434 below nip 438 and the vacuum supply serving roll 436 is turned on. Therefore, at this instant the ducts of bores 510 and 512 are registered at nip 438, and both draw a vacuum. (Bores 510 and 512 are the first two to come together at nip 438 after the vacuum to the portion of roll 436 below nip 438 is turned on. When a vacuum is drawn from both sides of the superimposed webs, the superimposed webs are temporarily split apart below nip 538, as each web is more strongly affected by the duct to which it is nearest.

Figure 24:
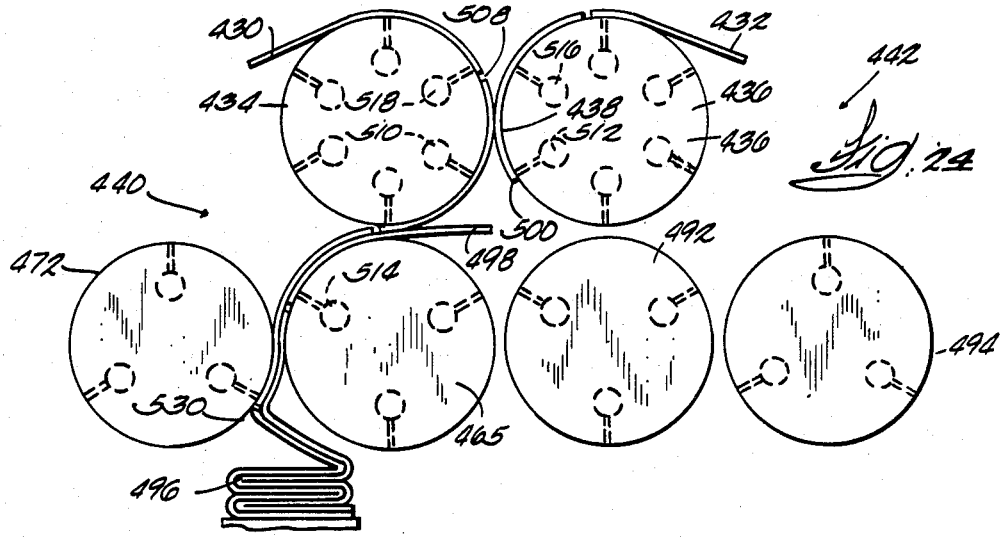
FIG. 24 is similar to FIG. 23, but shows the rolls rotated 30 degrees further and the first step by which the webs are separated into leading and trailing edges and the leading edges are directed toward the other folding station.

FIG. 24 shows the perforating rolls, folding rolls, and webs advanced 30 degrees beyond their positions in FIG. 23. Because the ducts associated with bores 510 and 512 are both drawing a vacuum and have rotated apart, the adjacent portions of the respective webs have been drawn apart. The trailing edge 498 of the severed web 432 is pulled by the ducts associated with bore 514 of roll 465, while the leading edge 500 of the severed web 432 is carried on the surface of roll 436 by the ducts associated with bore 512. Bore 512 is moving to the right in FIG. 24, while bore 514 is moving to the left, applying tension to the intermediate perforated portion 502 of the web. Edges 498 and 500 are therefore pulled apart. Corresponding tension is not applied to web 430 at this time because it is not attracted to the ducts associated with bore 512, but rather to the ducts associated with bore 510.

Figure 25:
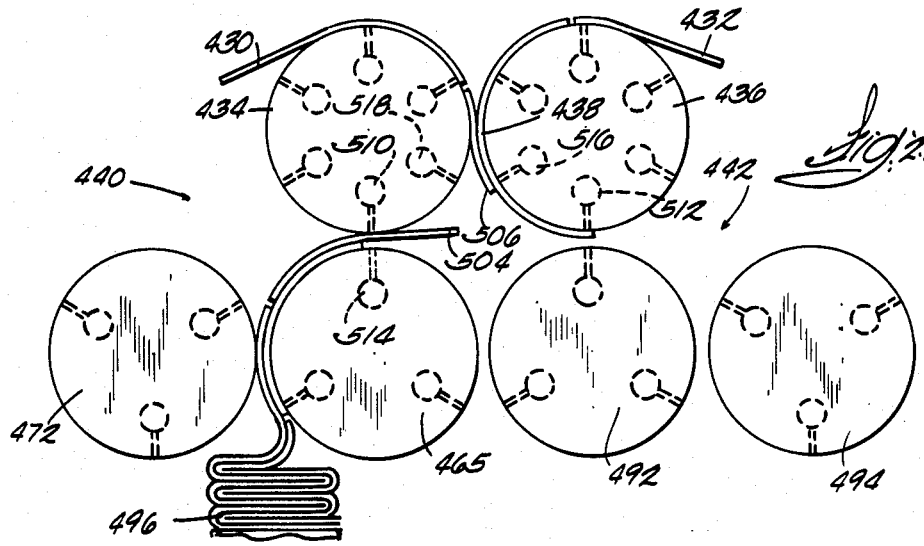
FIG. 25 is similar to FIG. 24, but shows the rolls rotated an additional 60 degrees and the final step of directing the superimposed webs from one folding station to the other.
Figure 27:
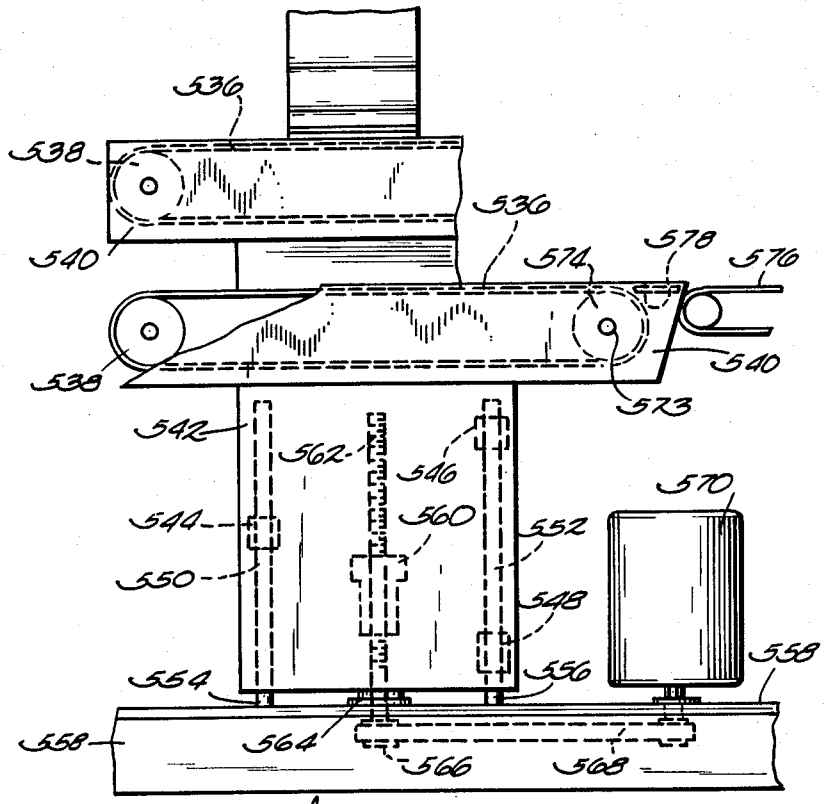
FIG. 27 is a contra-machine direction view of the elevators shown in FIG. 26, also illustrating two vertical extremities of travel of either elevator.

FIG. 25 shows the perforating rolls, folding rolls, and webs advanced 60 degrees beyond their positions in FIG. 24. Perforation 502 having been broken, the vacuum serving the lower portion of roll 434 is turned off, while the vacuum serving the lower portion of roll 436 on. As a result when the ducts corresponding to bores 516 and 518 come together, the ducts for bore 516 attract and hold both webs in superimposed relation after nip 438, while roll 434 has no effect at that point. The ducts associated with bore 516 thus draw both web 432 and the leading edge 506 of the next section of web 430 against roll 436, while the ducts associated with bore 514 of roll 465 draw the trailing edges of both webs against roll 465, thereby pulling trailing edge 504 and leading edge 506 (previously joined at perforation 508) apart because trailing edge 504 is being drawn to the left and leading edge 506 is being drawn to the right. Again, the web portions are broken at the perforation. As before, the ducts of bores 512, 516, etc. keep web 432 firmly against roll 436, so web 432 is not subjected to tension at the time web 430 breaks.

After the trailing edges of the web portions fed to folding station 440 are folded, the vacuum to rolls 465 and 472 is cut off until just before they are to begin folding again. Similarly, the vacuum to rolls 492 and 494 is turned on just previous to the point shown in FIG. 25 to start folding the web portion being directed to folding station 442.

The site of folding can be transferred from station 440 to station 442 or back at any time merely by switching the service of vacuum from the lower portion of one of rolls 434 and 436 to the lower portion of the other as just described. A convenient switching mechanism is shown in FIG. 19. Vacuum line 519 serves shoes 476 and 478 and is connected via a solenoid valve 520 to vacuum supply 521. Vacuum line 522 serves the lower portion of shoe 458 and is connected via solenoid valve 523 to a manifold vacuum supply 524. Vacuum line 525 services the lower portion of shoe 458 and is connected via solenoid valve 526 to vacuum supply 524. Vacuum line 527 serves the vacuum shoes of rolls 492 and 494, and is connected via solenoid valve 528 to vacuum supply 529. In a preferred mode of practicing the invention, the solenoid valves for the respective folding stations and for the lower portions of the respective perforating rolls are operated at the appropriate times by a programmable electronic control mechanism employing a rotation encoder mechanically interacting with one of the rollers to detect the angular travel of the rollers. If such a system is employed, each finished product stack such as 496 can have the exact sheet count desired for each consumer box of Z-folded tissues.

In the embodiment of FIGS. 19–27, it is important that the top 530 of each stack 496 remain at a constant position as the stack is formed, meaning that the stack must be steadily lowered as it is formed. Means are also needed to convey each finished stack from the folding station before a new stack is started. These functions are performed by the elevator mechanisms shown in FIGS. 26 and 27.

Figure 26:
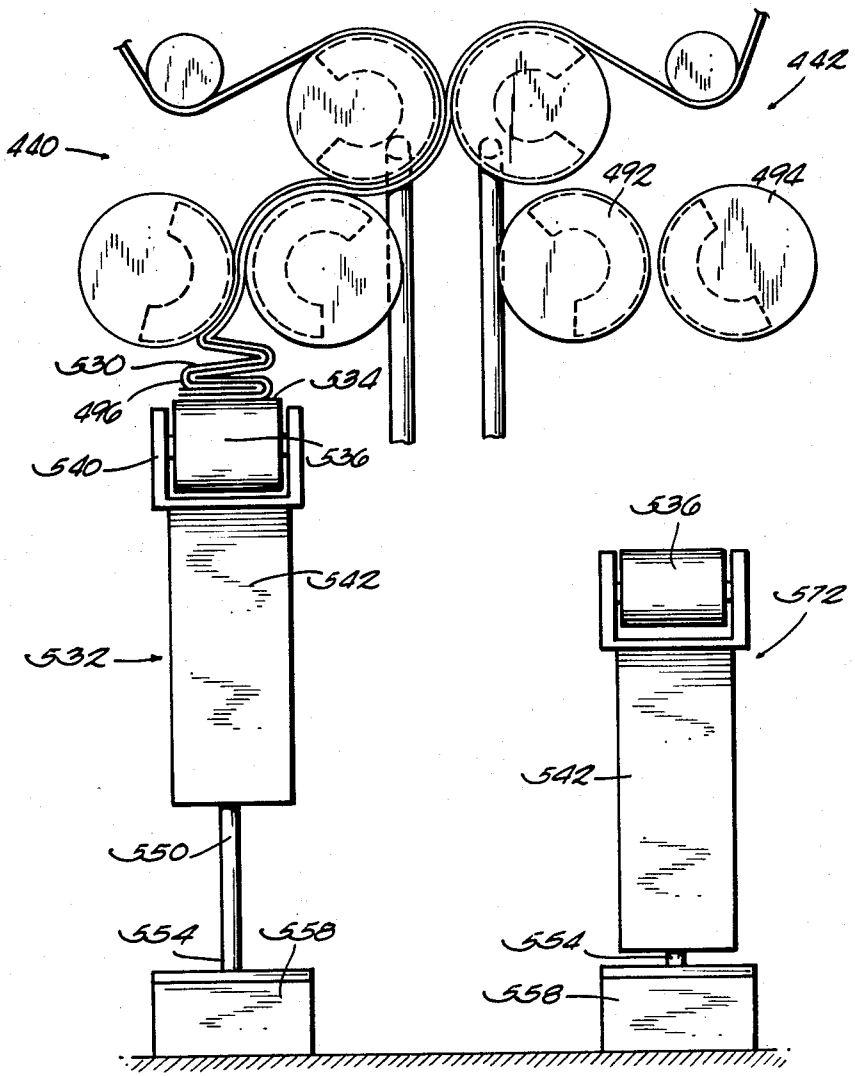
FIG. 26 is a view similar to FIG. 19, but further showing the elevators for supporting and transporting Z-folded tissue stacks.

FIG. 26 shows folding station 440 operating to form stack 496, while folding station 442 is temporarily idle (but rolls 492 and 494 continue to turn). Stack 496 is supported by an elevator 532 having a platform 534 defined by a horizontal run of an endless conveyor belt 536. Belt 536 is carried by rollers such as 538 journaled in a frame 540, which in turn is supported at the upper end of a housing 542. Housing 542 is secured to linear bearings 544, 546, and 548, which receive upstanding vertical guide rods 550 and 552 anchored at their lower ends 554, 556 to a fixed base 558. Also fixed to housing 542 is a nut assembly 560, which preferably includes a recirculating ball mechanism. Nut assembly 560 is threaded to a lead screw 562 which is supported at one end by a thrust and rotation bearing 564 secured to base 558. A sheave 566 at the lower extremity of lead screw 562 is driven by an endless belt 568, which in turn is driven by an electric motor assembly 570 secured to base 558. As motor assembly 570 is reversible, it can raise or lower housing 542, and thus platform top 534. While stack 496 is being formed, elevator 532 is lowered at the same rate as the height of the stack increases. To synchronize the rate of travel of elevators such as 532 and 572 with the rate of formation of the Z-folded stacks, the rotation encoder and programmable electronic control mechanism associated with the perforating and folding roll assembly can regulate the drive rate and direction of electric motor assembly 570, thereby regulating the speed and direction of travel of nut 560.

To convey a finished stack from the site of folding, the elevator is lowered to the position shown for elevator 572 in FIG. 26. Belt 536, which does not turn during stack formation, is driven by a motor 573 associated with roller 574 to convey the stack to further conveying means 576 via a transfer bed 578 secured to platform frame 540. Once the finished stack is received by conveying means 576, the rotation of conveyor belt 536 is again arrested and the elevator is raised to its upward extremity of travel, at which platform top 534 is substantially at the level of top 530 of the next stack to be formed. Thus, while one elevator is receiving and maintaining the level of one stack of tissues, the previously formed stack of tissues formed on the other elevator is conveyed away and the latter elevator is returned to its uppermost limit of travel. Folding can thus be continuous, yet discrete stacks of tissue, requiring only a minor amount of handling to become final consumer packages of Z-folded tissues, can be formed.

I claim:

1. An improved machine for perforating, superimposing, and Z-folding first and second tissue webs to form an interfolded stack of separable tissues, said machine comprising:

A. first and second counterrotating perforating rolls mounted on a frame and forming a first nip;

B. perforating means associated with said perforating rolls for forming periodic longitudinally spaced transverse tear lines in the respective webs;

C. first transport means for transporting said first web into said first nip on said first perforating roll, and for transporting said second web into said first nip on said second perforating roll, whereby to superimpose said webs at said first nip with the tear lines of said first web positioned longitudinally between the tear lines of said second web;

D. second transport means associated with said perforating rolls for alternately adhering said superimposed webs to one of said first and second perforating rolls approximately at said nip, transporting said adhered superimposed webs out of said nip by rotating said rolls, and then releasing said superimposed webs; and E. Z-folding means for folding said webs so each tear line of each web is tucked into a fold of the other web.

2. The machine of claim 1, wherein said Z-folding means comprises means for timing the alternate adherence of portions of said superimposed webs to said perforating rolls so each portion of said superimposed webs adjacent to a tear line of said second web is adhered to said first roll and transported out of the tangent plane of said first nip, and so each portion of said superimposed webs adjacent to a tear line of said first web is adhered to said second roll and transported out of the tangent plane of said first nip, thereby starting Z-folds at each said portion of said superimposed webs.

3. The machine of claim 2, further comprising fold tamping fingers for completing said Z-folds to form a tissue stack having a continuous sidewall and for advancing said tissue stack stepwise away from said first nip.

4. The machine of claim 3, further comprising a conduit to receive said tissue stack, said conduit having an inner friction surface to resist passage of the sidewall of said tissue stack therethrough, whereby to confine said stack in the machine direction between said friction surfaces and said fold tamping fingers.

5. The machine of claim 1, wherein said second transport means comprises a source of vacuum, a vacuum shoe adjacent each said perforating roll which is stationary with respect to said frame and extends approximately from said first nip circumferentially along the respective roll surfaces, and vacuum ducts through said roll surface for communicating via said vacuum shoes between a web carried on said roll and said source of vacuum.

6. The machine of claim 1, further comprising said cutting means for each perforating roll comprising perforating knives carried on each said perforating roll and cooperating with a stationary knife mounted to said frame whereby to form a tear line in the web portion carried adjacent each said perforating knife when the said perforating knife is carried past said stationary knife by said perforating roll.

7. The machine of claim 1, further comprising plural Z-folding means, means to direct said superimposed webs away from said first nip to one of said Z-folding means when transported by being adhered to said first perforating roll, and means to direct said superimposed webs away from said first nip to another of said Z-folding means when transported by being adhered to said second perforating roll.

8. The machine of claim 7, wherein each said Z-folding means comprises first and second counterrotating folding rolls supported on said frame, the first said folding roll forming a second nip with one said perforating roll downstream of said first nip, and the first and second said folding rolls forming a third nip downstream from said second nip.

9. The machine of claim 8, further comprising third transport means associated with said folding rolls for alternately adhering portions of said superimposed webs to said first and second folding rolls approximately at said third nip, transporting the said adhered portions out of the tangent plane of said third nip to start a Z-fold, and then releasing said adhered portions, such alternate adherence being timed so each tear line of each web is registered with an adhered portion of the superimposed webs.

10. The machine of claim 7, further comprising web severing means associated with said perforating rolls for severing said webs, and still further comprising web transfer means for adhering the leading edges of the cut superimposed webs to the free perforating roll, thereby transporting said superimposed webs to another said Z-folding means.

11. The machine of claim 10, further comprising sheet count means for operating said web transfer means each time a preselected number of tissues passes through said machine, thereby forming discrete tissue stacks in the respective Z-folding means, each said tissue stack having a predetermined tissue count.

12. The machine of claim 11, including elevator means comprising a platform for each said folding means to receive a stack of Z-folded tissue, said stack having an upper surface to which tissues are added by said folding means; drive means for lowering said platform to maintain said upper surface at one level while tissues are added to it; and stack conveying means for removing said stack from said platform when said stack is completely folded.

13. The machine of claim 12, wherein said drive means includes a controller for correlating the lowering of said platform to operation of said folding means, thereby lowering said platform at the same rate as tissues are added to said stack.

14. The machine of claim 12, wherein said platform comprises a horizontal run of an endless conveyor belt, and said stack conveying means comprises an encoder and programmable controller for sensing stack completion and drive means to rotate said belt, thereby conveying said stack away, when stack completion is sensed.

15. Z-folding means for forming superimposed webs with offset tear lines into an interfolded stack of separable tissues, said machine comprising first and second counterrotating folding rolls forming a nip, means for directing superimposed webs of tissue with offset tear lines through said nip, transport means associated with said folding rolls for alternately adhering portions of said superimposed webs to said first and second folding rolls approximately at said nip, and timing means for timing the alternate adherence of said superimposed webs on said folding rolls so the portions of said superimposed webs adjacent to a tear line of said second web are adhered to said first roll and thereby transported out of the tangent plane of said first nip, and so the portions of said superimposed webs adjacent to a tear line of said first web are adhered to said second roll and thereby transported out of the tangent plane of said first nip, thereby starting a Z-fold at each said region of said first and second webs.

* * * * *